US005681252A

United States Patent [19]

Ziegler

[11] Patent Number: 5,681,252

[45] Date of Patent: Oct. 28, 1997

[54] APPARATUS FOR CONSTRUCTING MULTI-PIECE CARTON PRE-FORMS

[75] Inventor: Kelly W. Ziegler, Crosby, Minn.

[73] Assignee: Riverwood International Corporation, Atlanta, Ga.

[21] Appl. No.: 534,251

[22] Filed: Sep. 26, 1995

Related U.S. Application Data

[63] Continuation-in-part of Ser. No. 326,590, Oct. 20, 1994.

[51] Int. Cl.[6] ..... B31B 17/02

[52] U.S. Cl. ..... 493/84; 493/90; 493/379; 493/114; 493/120

[58] Field of Search ..... 493/84, 89, 90, 493/92, 379, 344, 120, 114, 121, 122, 128

[56] References Cited

U.S. PATENT DOCUMENTS

| | | | |
|---|---|---|---|
| 1,402,259 | 1/1922 | Smith | 493/68 |
| 2,243,051 | 5/1941 | Neely | 493/120 |
| 2,486,893 | 11/1949 | Van Doren | 493/120 |
| 2,826,127 | 3/1958 | Straw | 493/120 |
| 2,898,823 | 8/1959 | Drew et al. | 493/84 |
| 2,962,944 | 12/1960 | Neely | 493/120 |
| 3,130,648 | 4/1964 | Arneson | 493/122 |
| 3,196,761 | 7/1965 | Ullman | 493/122 |
| 3,269,724 | 8/1966 | Lefief | 493/167 |
| 3,583,295 | 6/1971 | Elder | 493/120 |
| 3,659,505 | 5/1972 | Wasyluka et al. | |
| 4,023,471 | 5/1977 | Royal | 493/114 |
| 4,093,207 | 6/1978 | Greenwell et al. | 271/100 |
| 4,177,715 | 12/1979 | Meyers . | |
| 4,197,789 | 4/1980 | Moen . | |
| 4,292,034 | 9/1981 | Probyn | 493/92 |
| 4,303,405 | 12/1981 | Reichert | 493/92 |
| 4,336,094 | 6/1982 | Mills . | |
| 4,398,901 | 8/1983 | Campbell . | |
| 4,581,005 | 4/1986 | Moen . | |
| 4,605,464 | 8/1986 | Slevin | 493/90 |
| 4,650,448 | 3/1987 | Urso | 493/89 |
| 4,708,707 | 11/1987 | Koike et al. | 493/122 |
| 4,798,571 | 1/1989 | Everman et al. | 493/114 |
| 4,861,325 | 8/1989 | Di Marzio et al. | 493/128 |
| 5,057,066 | 10/1991 | Nagahashi et al. | 493/122 |
| 5,108,355 | 4/1992 | Walsh | 493/89 |
| 5,184,996 | 2/1993 | Rode et al. | 493/84 |

FOREIGN PATENT DOCUMENTS

WO9612614 5/1996 WIPO .

*Primary Examiner*—Joseph J. Hail, III
*Assistant Examiner*—Darren Ark
*Attorney, Agent, or Firm*—Joel D. Skinner, Jr.; Steve M. McLary

[57] ABSTRACT

An apparatus for constructing multi-piece carton pre-forms, comprising a wrap member supply hopper, a wrap/pre-form conveyor, a glue station, a web placement and compression station including a web supply magazine and a reciprocating placer, and an output station. The apparatus processes paperboard pre-forms which are subsequently erected into cartons for fresh produce and the like. An improved packaging member conveyor is also disclosed.

5 Claims, 9 Drawing Sheets

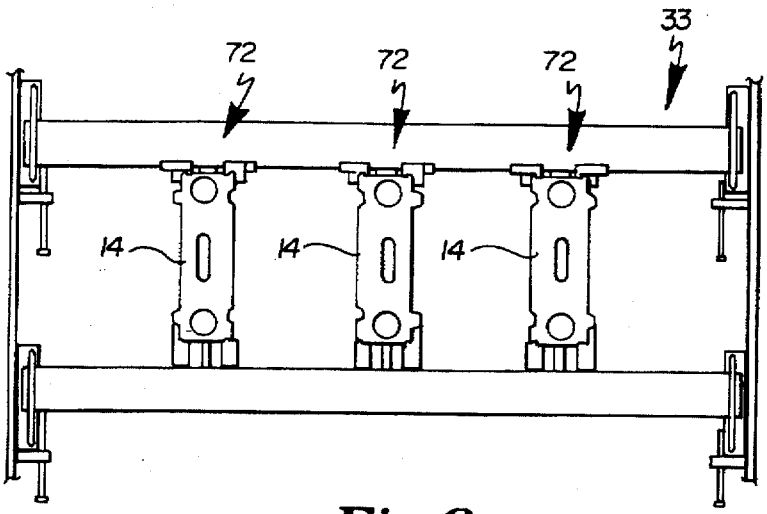
Fig. 8a
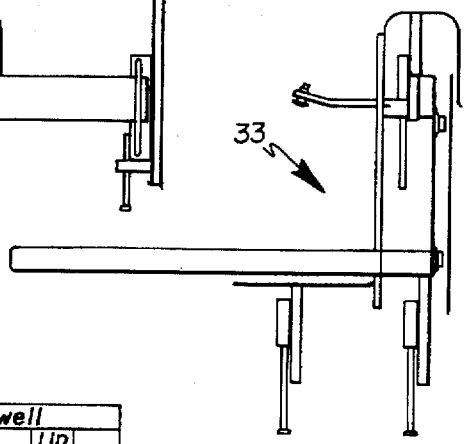
Fig. 8b
| | | | | | |
|---|---|---|---|---|---|
| CARRIAGE | INDEX | Dwell | Return | Dwell | |
| FINGERS | Dwell Up | Down | Dwell Down | Up | |
| WEB PLACER | ←Pick | Fall | Dwell (Comp) | Rise | |
| LOCATING PINS | Dwell Down | Rise 6° | Dwell Up | Fall | Dwell Down |
Fig. 14

APPARATUS FOR CONSTRUCTING MULTI-PIECE CARTON PRE-FORMS

CROSS-REFERENCE TO RELATED APPLICATION

This application is a continuation-in-part of application Ser. No. 08/326,590, filed Oct. 20, 1994.

BACKGROUND OF THE INVENTION

1. Field of the Invention

This invention relates to packaging apparatus and methods, and more particularly to an apparatus for constructing pre-forms for cartons. The pre-forms have a low profile which makes them best suited for storing and shipping. The pre-forms are later erected into cartons of the type that are particularly useful for packaging produce such as fresh fruits and vegetables.

2. Background Information

Paperboard cartons or containers are an important packaging vehicle for vegetable and fruit producers worldwide. Tray-style paperboard containers are an especially important packaging option for growers of strawberries, blueberries, raspberries, cherries and tomatoes because they function as on-site, initial packaging means, shipment means and as retail packaging means. The containers are sturdy, stable when wet, stackable and are not fully enclosed to permit filling, contents inspection, and ventilation. This type of container also provides improved external panel spaces for high quality graphics printing and advertising.

The erected cannon is rectangular, somewhat flat, open at its top and has a pair of compartments. The cannon comprises a relatively wide tray or wrap member, and at least two web or panel members at the ends of the wrap. In addition, one web may be placed in the middle of the wrap to separate the container into two compartments and two webs may be placed proximate the middle to enable the carton to be split into two smaller cartons. Other embodiments of the subject containers are disclosed in U.S. Pat. Nos. 5,116,290 and 5,316,207, assigned to applicant's assignee. Importantly, all of the above described carton embodiments are erected from a substantially flat carton pre-form. Carton erecting is relatively easy and fast and may be accomplished manually or with the use of a simple tool. The advantage of this is that the pre-forms are compact and easy to store and transport.

A feature of the cartons which is significant with respect to their mode of construction, is that they comprise several separate and distinct carton components or blanks. The components are brought together and attached to form the substantially flat pre-carton or pre-form. The flat pre-forms are compact and easily stored and transported. They are erected into a completed carton at a later time, often at a location remote from the assembly location.

The multi-component design of the cartons places significant design limitations and requirements on machinery for assembling pre-forms. For example, the individual components must be brought into precise alignment or defects will likely be present in the carton. The apparatus of the present invention provides a means of automatically constructing tray-style carton pre-forms such as those discussed above. The apparatus processes pre-forms at relatively high speed. The apparatus is unitary and compact, and therefore provides advantages in terms of shipping and layout on the premises of the user. Importantly, the apparatus is able to process multi-piece carton pre-forms accurately and reliably.

The only known apparatus for constructing cartons such as those described above is the VERTIPACK™ Machine, manufactured by Applicants' assignee, Riverwood International Corporation of Atlanta, Ga. The VERTIPACK machine operates in both a cartoning mode where pre-forms are fully erected into cartons and in a pre-form mode where pre-forms are output. The apparatus of the present invention is believed to provide a simpler, economical alternative to the VERTIPACK Machine.

SUMMARY OF THE INVENTION

The present invention provides an apparatus for constructing multi-piece, low profile, substantially flat, carton pre-forms. The basic apparatus comprises: (1) a first blank (wrap) input mechanism, preferably a hopper, (2) a second blank (web) input mechanism, preferably a magazine, (3) means to place and affix at least one second blank on each first blank, preferably a reciprocating placer, and (4) a conveyor mechanism operatively disposed adjacent the first blank input mechanism and the means to place and affix. The conveyor mechanism transports first blanks from the first blank input mechanism to the means to place and affix, and to an output location or station.

In another aspect of the invention a conveyance mechanism is provided for use in a packaging system, the conveyance mechanism comprising a revolving endless member having a forward longitudinal run, a longitudinally reciprocating carriage member connected to the endless member, the carriage member having means to engage and disengage a packaging member, and means to control reciprocating movement of the carriage member and to control the means to engage and disengage.

The features, benefits and objects of this invention will become clear to those skilled in the art by reference to the following description, claims and drawings.

BRIEF DESCRIPTION OF THE DRAWINGS

FIGS. 8A and B illustrate a view projection looking straight up the web lanes of the web magazine.

FIG. 14 is a chart showing the relative activation states of various components of the apparatus.

DESCRIPTION OF THE PREFERRED EMBODIMENT

The apparatus of the present invention automatically assembles multi-piece packaging container blanks or carton pre-forms from individual carton components. The components are attached to one another by the apparatus to yield a substantially flat carton pre-form 10 and the pre-form is then output from the apparatus. The pre-form 10 is later erected into a completed carton at another location, for example on a grower's premises, without the use of the apparatus.

Figure 11:
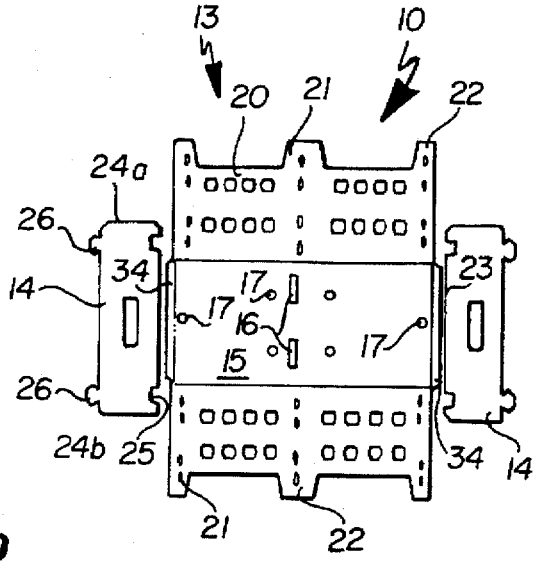
FIG. 11 is a top view of a wrap and two panels.
Figure 12:
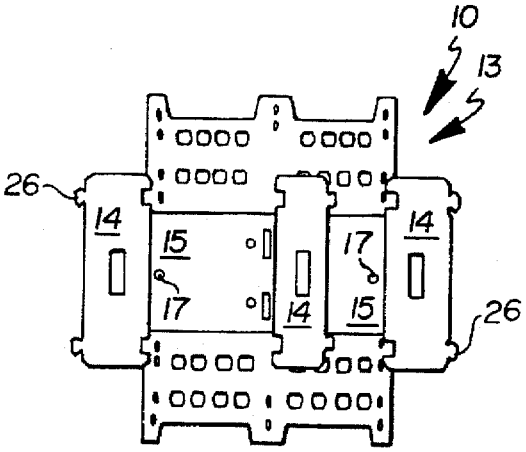
FIG. 12 is a top view of a completed blank or pre-carton constructed by the apparatus of this invention, with a wrap and three attached panels.
Figure 13:
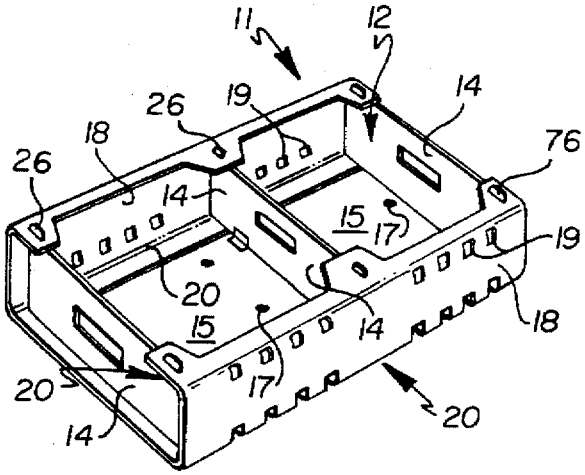
FIG. 13 is a perspective view of a fully formed carton which is erected at a later time from the blank constructed by the apparatus of this invention.

FIG. 11 shows select individual components or blanks of one embodiment of the carton. FIG. 12 shows the paperboard carton pre-form 10 formed by the apparatus of this invention from the blank components. FIG. 13 shows the carton 11 which is later erected from the pre-form 10. The erected carton 11 is rectangular, somewhat flat, open at its top and has a pair of compartments 12. The carton 11 comprises a relatively wide wrap member 13 and three web or panel members 14. A middle web 14 separates the compartments 12. Each wrap 13 has a flat base 15 with foldable members 16 and pass through apertures 17, front and back sides 18 with apertures 19 defining top and bottom edges 20, and connection slots 21 in fold-over tabs 22. The web panels 14 have top and bottom long ends 23, front and back short ends 24*a* and *b*, bottom notches 25 and top tabs 26. Glue strips 34 are deposited on foldable members of the wrap 13. Each web 14 is placed so that one side of its bottom long edge contacts the glue strip 34 of a foldable member. The webs 14 are placed flat with respect to the wrap. After a predetermined compression and cure period on the order of one second, the webs 14 are moved to a vertical position and the sides of the wrap 13 are folded over the web 14 short end so that the connection slots 21 mate with the web tab 26 and comers of the web 14 to form a locked completed carton.

The apparatus of this invention may be modified to construct pre-forms for a variety of canons including those with no middle web, a single middle web and two middle webs.

Figure 1:
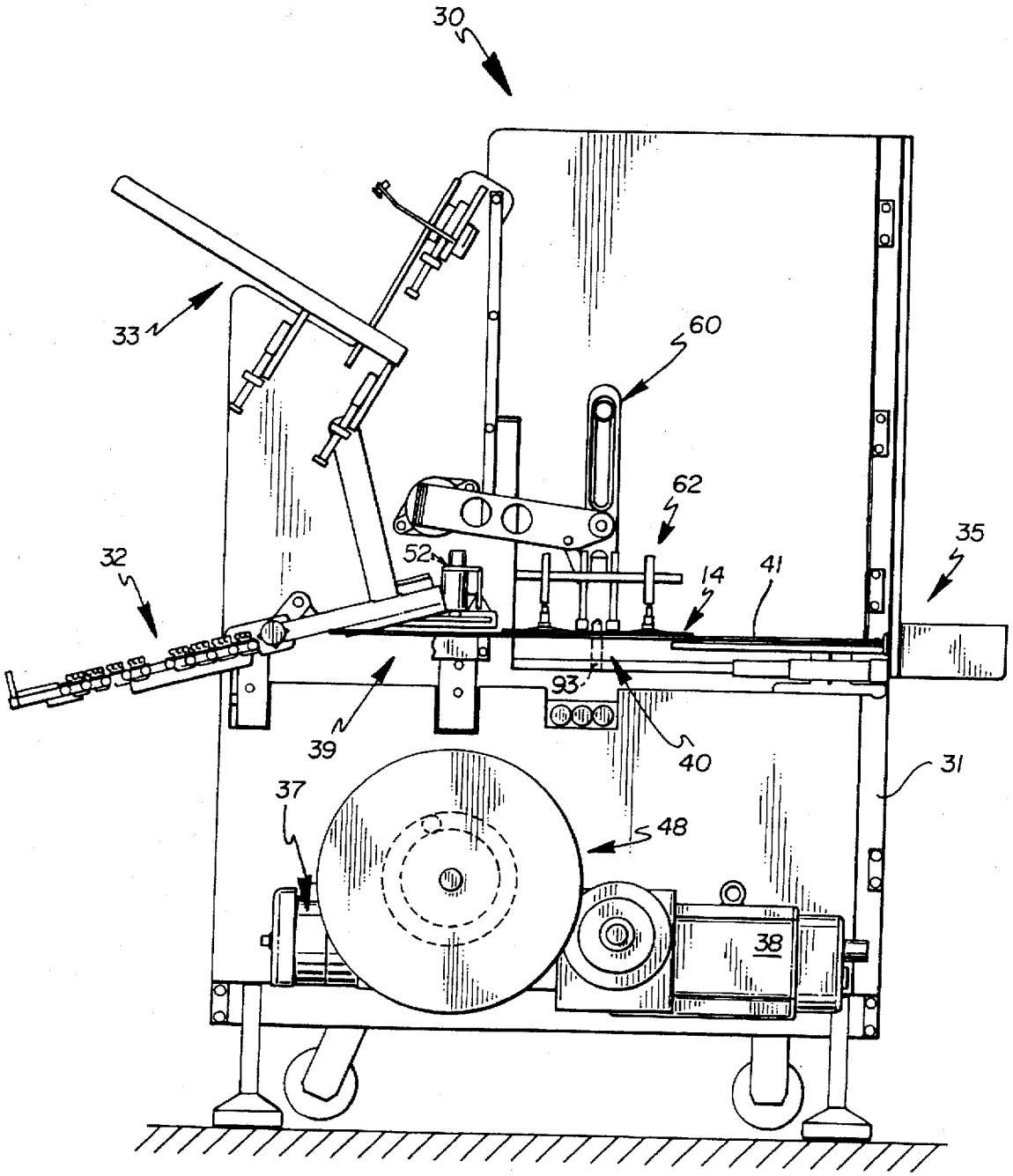
FIG. 1 is a side elevation view of the apparatus of the present invention.
Figure 2:
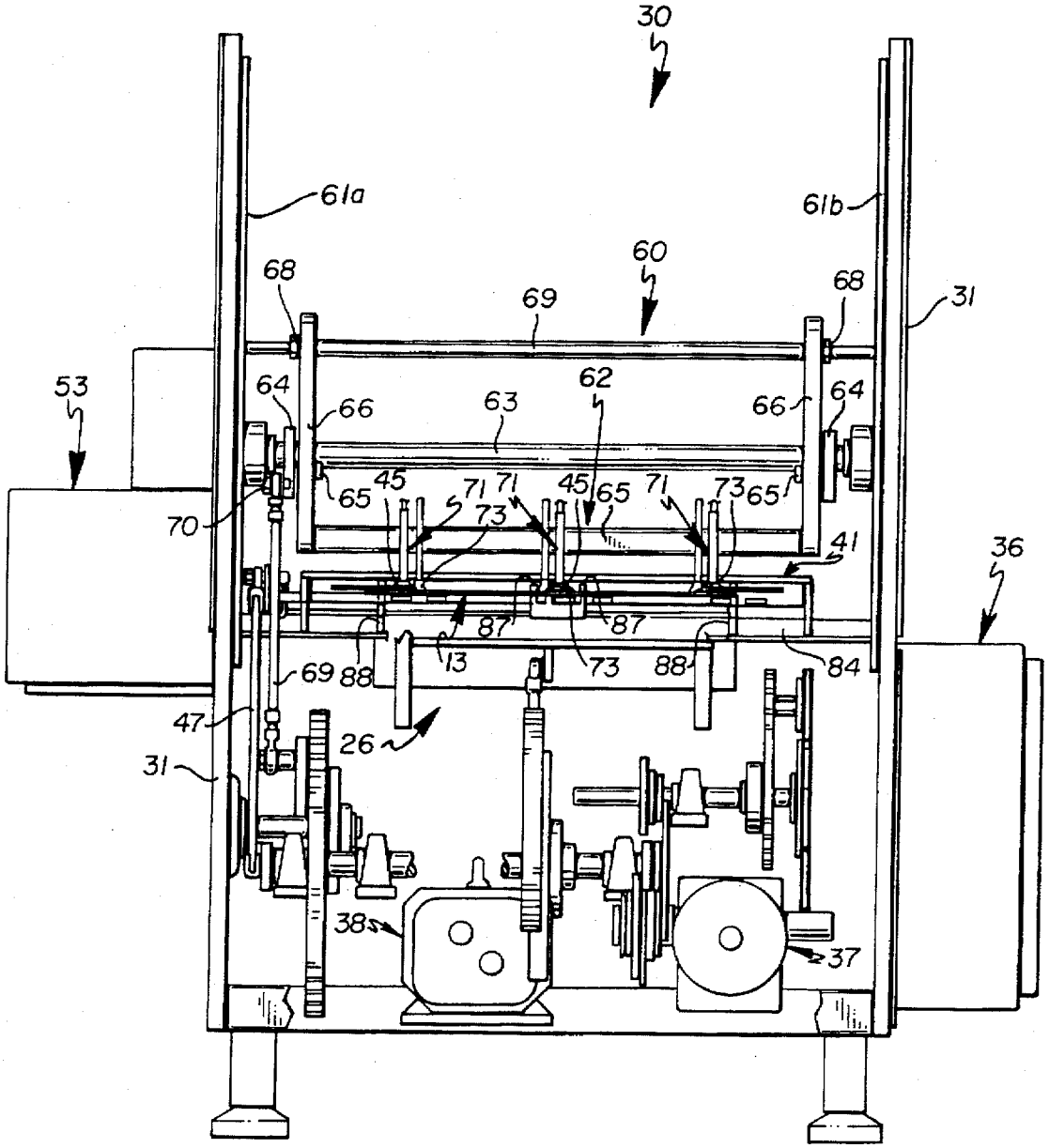
FIG. 2 is an end view, taken from the right side of FIG. 1, of the apparatus.
Figure 3:
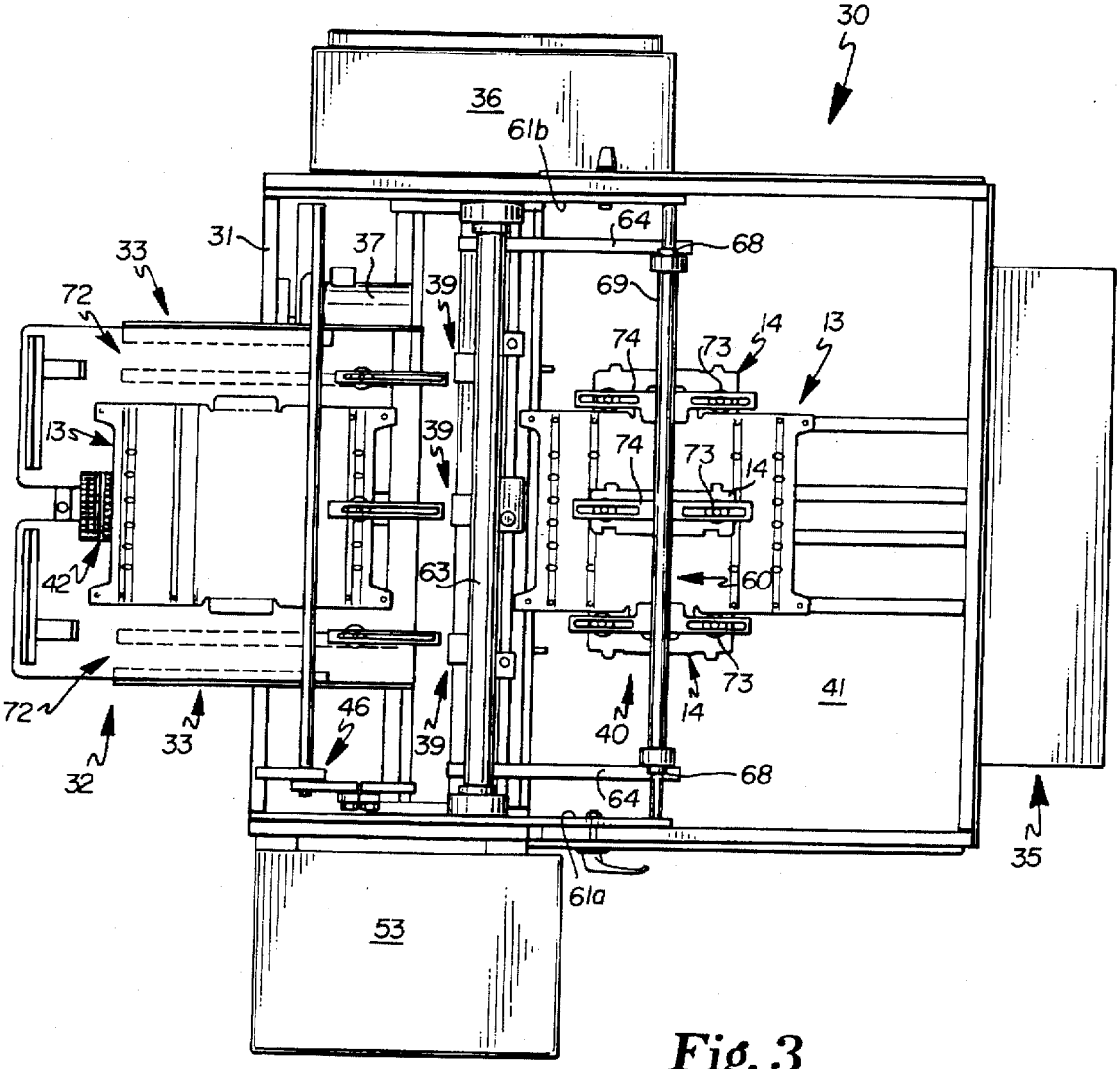
FIG. 3 is a top, plan view of the apparatus.

Referring to FIGS. 1–3, the apparatus 30 is supported by a rigid frame 31 which has a generally square configuration as viewed from the top. The frame 31 design provides a unitary and compact machine which is able to be shipped substantially assembled. This reduces shipping and set-up costs. Attached to the frame 31 is an electrical enclosure 36 which houses various power and control components of the apparatus 30. The mechanical systems of the apparatus 30 are preferably powered by a single approximately 1.5 horsepower electric motor 37 and the vacuum systems of the apparatus 30 are preferably powered by a vacuum pump 38.

The basic structure and function of the apparatus 30 are as follows. The apparatus 30 has a pair of input locations for loading of carton components, namely a tray or wrap hopper 32 and a web magazine 33. The overall apparatus 30 configuration places these input elements 32 and 33 within convenient reach of the operator. The apparatus 30 has an output station 35 for discharge of carton pre-forms 10. A conveyor assembly 26 cyclically transports an individual wrap 13 from the wrap hopper 32, over a flat product deck 41 through a closely spaced glue station 39 at a predetermined speed for deposit of glue thereon, and to a web feeding and compression station 40 where movement of the wrap 13 is halted for a predetermined time period. At this station 40, webs 14 are deposited at the station and attached to each wrap 13 to form a carton pre-form 10. The conveyor 26 then transports the carton pre-form 10 from the web feeding and compression station 40 to the output station 35.

Figure 4:
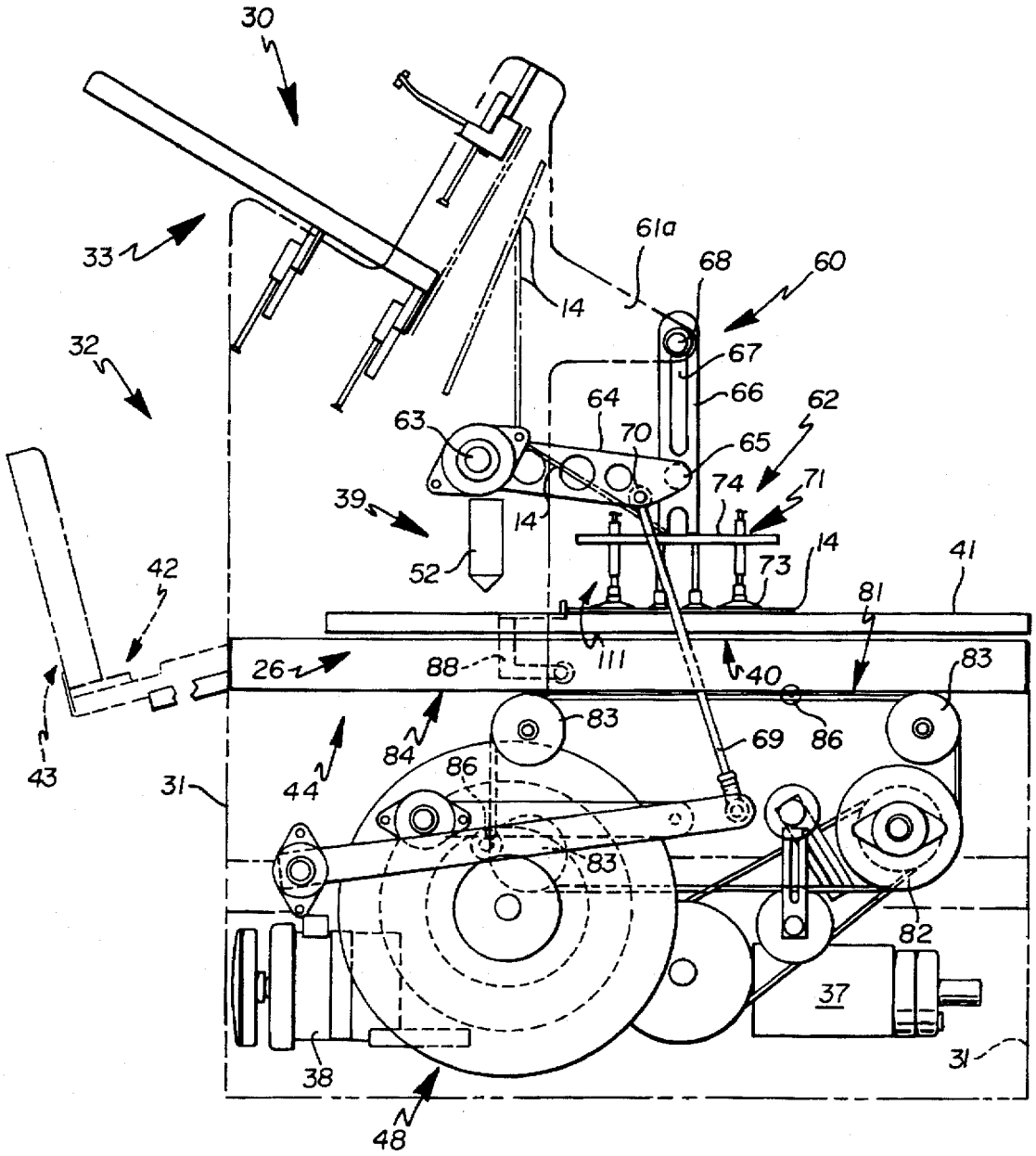
FIG. 4 is a detailed side view of the apparatus.
Figure 5:
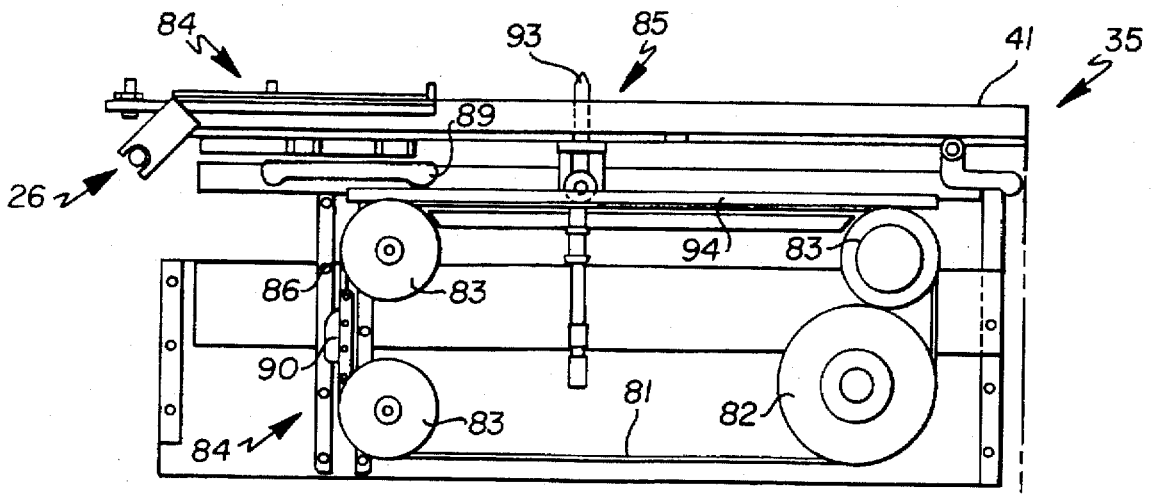
FIG. 5 is a side view of the wrap feed and locating pin section of the apparatus.
Figure 6:
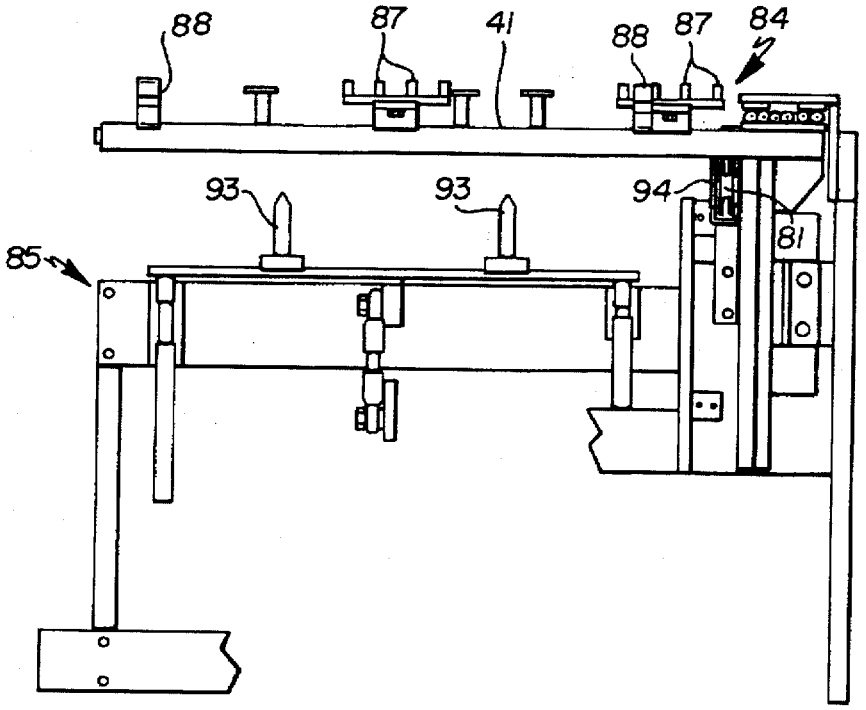
FIG. 6 is an end view of the section shown in FIG. 5.
Figure 7:
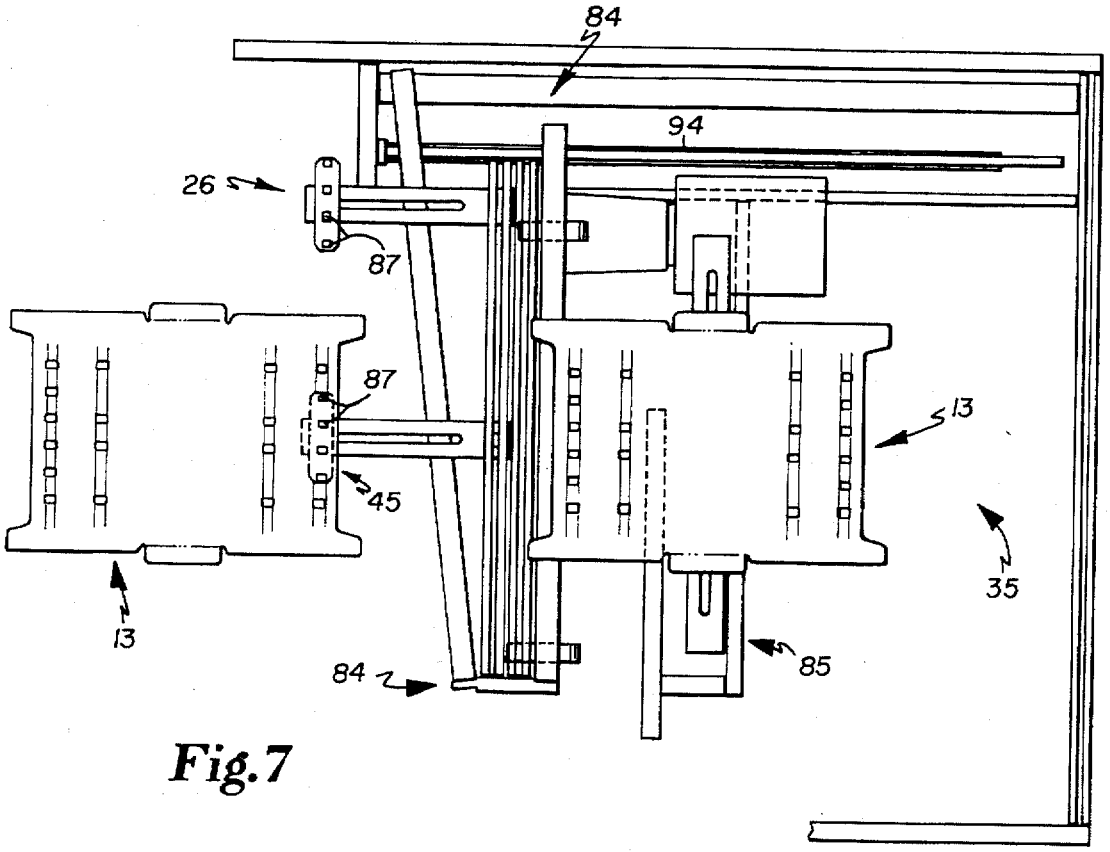
FIG. 7 is a top view of the section shown in FIG. 5.
Figure 9:
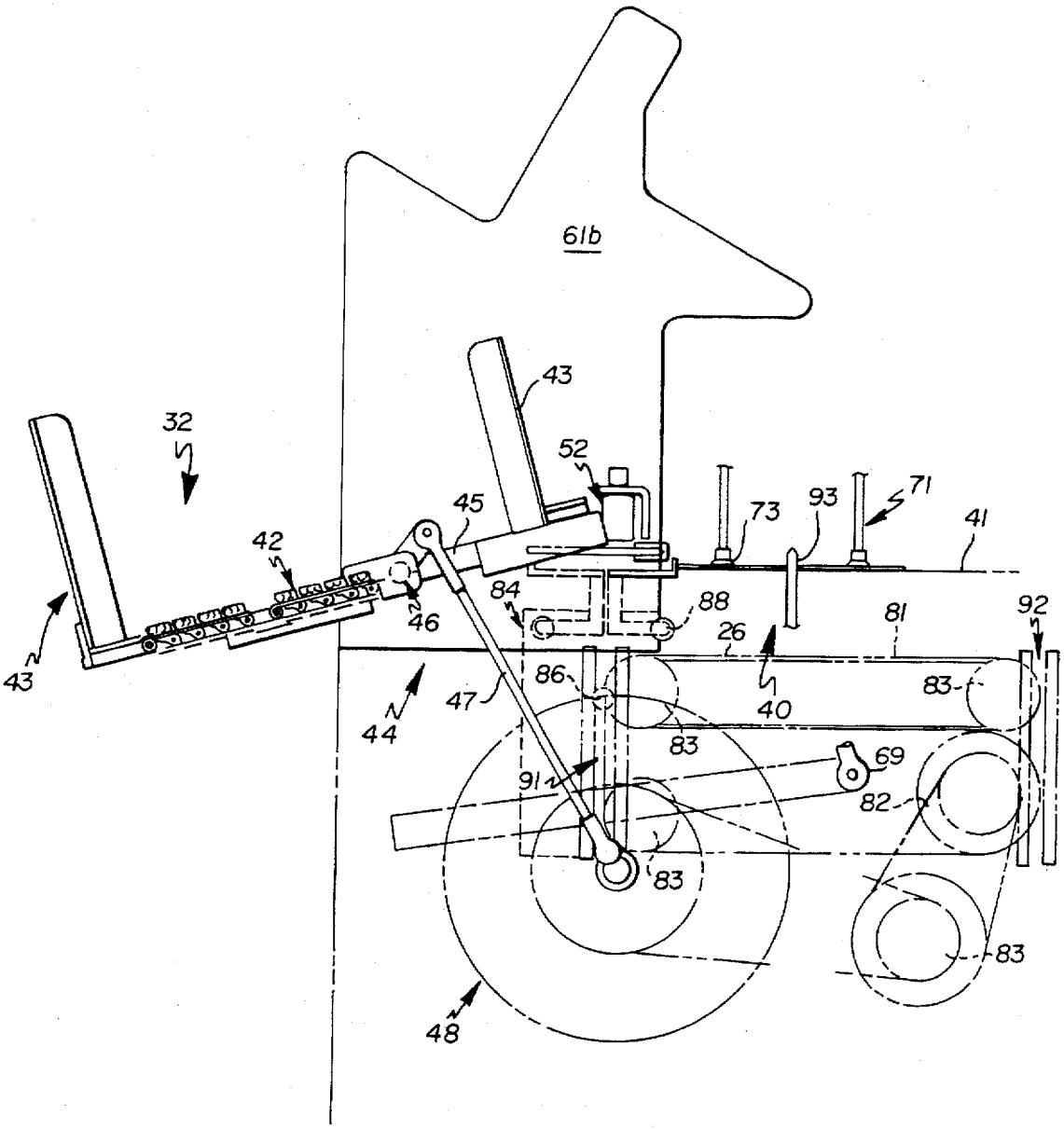
FIG. 9 is a side view of the wrap magazine and glue sections of the apparatus.

Referring to FIGS. 4 and 9, the wrap hopper 32 includes a roller base 42, a retainer 43, and a vacuum pick mechanism 44. The wrap hopper 32 holds a vertical stack of flat wraps 13. Wraps 13 are loaded or input from the top and picked and fed or output from the bottom of the hopper 32. The roller base 42 provides a low friction surface across which the bottom-most wrap slides after it is grasped by the vacuum pick mechanism 44 and engaged and moved by the conveyor 26. The vacuum pick mechanism 44 has one or more, in this embodiment three (3), vacuum pick cups 45 the movement of which are controlled through connections to a lateral linkage assembly 46, vertical arm 47 and control cam assembly 48 and the drive motor 37, via interconnected, commonly known drive gear and linkage components. The vacuum cups 45 are communicatively connected to the vacuum pump 38. Importantly, the roller base is preferably angled at approximately 15 degrees relative to a horizontal plane to reduce pressure on the bottom-most wrap blank 13 caused by the stack of blanks located on top of it.

Referring also to FIGS. 5–7, 9 and 14, the conveyor 26 engages a wrap 13 at the wrap hopper 32. It then pulls the wrap 13 forward under the glue station 39 where glue is deposited in predetermined strips as discussed above. The conveyor 26 continues to pull the wrap 13 to the web feeding and compression station 40 wherein two or more webs (three (3) webs 14 are shown in this embodiment) 14 are placed on the wrap 13 and compressed for a predetermined time period, for example approximately one second, to allow the glue to cure and bond the webs 14 to predetermined foldable components of the wrap 13. The wrap 13 and connected webs 14 are subsequently pushed to the discharge station 35 for output.

The conveyor 26 basically comprises a single chain 81 disposed about drive 82 and idler 83 sprockets, a transfer carriage 84, and a locating pin mechanism 85. The chain 81 has an upper forward run of a predetermined length and an associated guide structure 94, and a bottom return run. The transfer carriage 84 is disposed immediately below the level of the product deck 41 and above the upper run of the chain 81. The transfer carriage 84 is laterally elongated and is communicatively connected to the chain 81 by a single carriage drive bearing 86. The transfer carriage 84 is conveyed longitudinally, forwardly and is returned at the same vertical level along the forward and return travel paths of the chain bearing 86, respectively. The carriage 84 has a first dwell period at the upstream end of the conveyor 26 where a wrap 13 is engaged from the wrap hopper 32, and a second dwell period at the placement and compression station 40 where the wrap 13 is disengaged from the carriage 84 and engaged by the locating pin assembly 85. Subsequent the later dwell period, the carriage 84 is reciprocatingly returned to the upstream end of the conveyor 26 by the action of the bearing 86 traveling along the bottom nm of the chain 81. The carriage 84 dwell periods correspond to the bearing 86 vertically ascending and descending along the chain travel path in carriage cam tracks 91 and 92.

The carriage 84 has a plurality of vertically aligned engagement members or fingers 87 and a plurality of discharge pushers 88 which are connected to the carriage by a lift arm 89. The fingers 87, when raised at the upstream end of the conveyor 26, engage the wrap 13 at predetermined apertures thereon, and pull it longitudinally forward. At the placement and compression station 40, the fingers 87 lower and the discharge pushers 88 disengage the pre-form 10 from the carriage 84. The movement of the fingers 87 and discharge pushers 88 is controlled by the dual lobed lift block 90, which is connected to the chain 81, contacting the lift arm 89.

The locating pin assembly 85 comprises a pair of vertically movable pins 93 which raise to engage the wrap 13 at the placement and compression station 40 to precisely locate and stabilize the wrap 13 during placement of the webs 14 on the wrap 13. Alter compression, the pins 93 retract to permit the now formed pro-form 10 to be pushed downstream on the product deck 41 by the next wrap 13 indexed by the carriage 84. The relative and synchronized actuation states of the carriage 84, fingers 87, web placer 60, and locating pins is shown in the chart of FIG. 14.

The glue station 39 comprises two or more glue guns 52, in this embodiment three (3), disposed in side by side alignment at a predetermined height above the conveyor 26. Laterally, the guns 52 are adjustably positioned so as to deposit linear strips of glue (not shown), of a predetermined length, on the moving wrap 13 at locations which correspond to the connection thereon of the bottom edges of the webs 14, for example along the glue tabs 34 of the wrap 13. The glue guns 52 are connected to and receive glue from a supply system 53. Due to the design of the hopper 32, conveyor 26 and glue guns 52, the glue station 39 is allowed to be closely spaced to the hopper 32, which enhances the compactness of the apparatus 30.

Referring also to FIG. 8*a* and *b*, the web feeding and compression station 40 comprises a web feeder/compressor 60 which places webs 14 in position on the wraps 13 and holds the webs 14 in place with a predetermined pressure to permit glue bonding. The web feeder/compressor 60 is attached to parallel spaced pairs of coupled frame members 61*a* and *b*, the web magazine 33, and a vacuum actuated reciprocating placement mechanism 62. The placement mechanism 62 comprises a first pivot shaft 63 laterally, fixed to the frame members 61, a pair of first arms 64 which are pivotally attached at their lower ends to the first shaft 63, a connector 65 pivotally connected to the opposite end of the first arms 64, and a pair of second arms 66 including a slide channel 67 which is slidingly and pivotally coupled to followers 68 mounted to the ends of a second shaft 69 which is fixed to the outwardly extending end of the frames 61. This assembly 62 is driven by arm 65 which is connected at a bottom end to the control cam assembly 48 and at a top end to one first arm 64 via a connector 70. At least two pairs, in this embodiment three, of vacuum actuated engagement arms 71, of a design known in the art, are fixed to the second shaft 65 by a connection bar 74, each pair of arms 71 being assigned to one web holder or lane 72 of the web magazine 33. Each arm of the pair 71 has a cup-type vacuum engagement head 73 for contact with the web 14. The arms 71 are communicatively connected to a known vacuum control mechanism, and to the vacuum pump 38. In cooperation with the vacuum control mechanism, the placer 62 reciprocatingly engages two or more webs 14, in this embodiment three, from the magazine 32 and by arms 64 and 66 pivoting about the shafts 63 and 68 respectively, and via sliding movement of the followers 68 in the channel 67, picks the webs 14 from their initial angled position in the magazine 33 and moves and places them in a final horizontal position in compressing contact with a wrap 13 disposed in the web feeding and compression area 40.

Figure 10A:
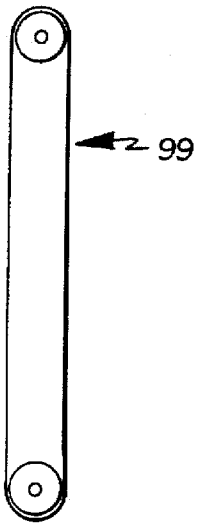
FIGS. 10A and B show an adjustable carton set up tool.
Figure 10B:
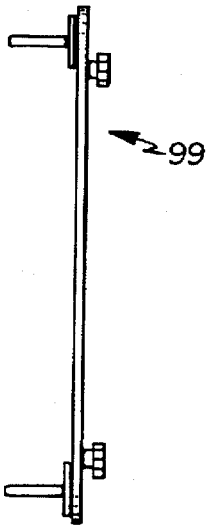

FIGS. 10*a* and *b* show a set up tool 99.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof; including both structural equivalents and equivalent structures.

The invention claimed is:

1. An apparatus for constructing multi-piece, substantially flat, paperboard carton pre-forms, comprising a first blank input mechanism, first blanks consisting of foldable wrap members, a second blank input mechanism, second blanks consisting of panel members, means to place and affix at least two of said second blanks on each of said first blanks, a conveyor mechanism operatively disposed adjacent said first blank input mechanism and said means to place and affix, said conveyor mechanism transporting said first blanks from said first blank input mechanism to said means to place and affix, and to an output location, and a glue deposit mechanism for depositing glue trails on at least two predetermined locations on said wrap members, said glue trails being for affixation of said panel members to said wrap members, said glue deposit mechanism being disposed adjacent said conveyor mechanism said means to place and affix being a reciprocating placer, said placer comprising a frame, a reciprocating arm assembly attached to said frame and disposed above a second end of said conveyor mechanism, and at least two vacuum actuated pick and release contacts coupled to said reciprocating arm assembly, whereby said two vacuum actuated pick and release contacts grasp said panel members from said second blank input mechanism and move said panel members into position on one of said wrap members disposed on said conveyor mechanism, place said web members on one of said wrap members, in contact with said glue trails, compress said panel members for a predetermined glue curing time period to yield a substantially flat pre-form, and release said panel members.

2. The apparatus of claim 1, wherein said first blank input mechanism is a wrap hopper, said wrap hopper holding a plurality of flat, horizontally oriented wrap members and outputting said wrap members from a bottom area thereof at a predetermined angle.

3. The apparatus of claim 2, wherein said predetermined angle is approximately 15 degrees elevated from a horizontal plane.

4. The apparatus of claim 2, wherein said wrap hopper comprises a low friction roller base and vacuum driven means to pick and move one of said wrap members from said hopper bottom.

5. The apparatus of claim 1, wherein said conveyor mechanism comprises a revolving endless member having a forward longitudinal run, a longitudinally reciprocating carriage member connected to said endless member, said carriage member having means to engage and disengage said first blanks, and means to control reciprocating movement of said carriage member and to control said means to engage and disengage.

* * * * *